United States Patent [19]

Brown

[11] Patent Number: 4,567,341

[45] Date of Patent: Jan. 28, 1986

[54] SIDE VENTED AND SHIELDED MICROWAVE PIZZA CARTON

[75] Inventor: Richard K. Brown, Appleton, Wis.

[73] Assignee: James River-Norwalk, Inc., Norwalk, Conn.

[21] Appl. No.: 637,056

[22] Filed: Aug. 2, 1984

[51] Int. Cl.[4] ..... H05B 6/64

[52] U.S. Cl. ..... 219/10.55 E; 219/10.55 F; 426/243; 426/118; 426/107; 426/113; 229/31 R; 220/366

[58] Field of Search ..... 219/10.55 E, 10.55 F, 219/10.55 R; 426/243, 234, 107, 113, 114, 118; 220/366, 367, DIG. 27; 229/31, 34

[56] References Cited

U.S. PATENT DOCUMENTS

| | | | |
|---|---|---|---|
| 2,339,445 | 1/1944 | Wynne et al. | 229/34 |
| 3,854,021 | 7/1973 | Moore et al. | 219/10.55 R |
| 4,013,798 | 12/1975 | Goltsos | 219/10.55 E |
| 4,027,132 | 5/1977 | Levinson | 219/10.55 F |
| 4,058,214 | 11/1977 | Mancuso | 220/366 X |
| 4,345,133 | 8/1982 | Cherney et al. | 219/10.55 E |
| 4,351,997 | 9/1982 | Mattison et al. | 219/10.55 E |
| 4,373,659 | 2/1983 | Cornell et al. | 229/31 X |
| 4,497,431 | 2/1985 | Fay | 219/10.55 E X |
| 4,505,391 | 3/1985 | Kuchenbecker | 219/10.55 E X |

FOREIGN PATENT DOCUMENTS

| | | | |
|---|---|---|---|
| 2464202 | 4/1981 | France | 220/DIG. 27 |

*Primary Examiner*—Philip H. Leung

*Attorney, Agent, or Firm*—Sixbey, Friedman & Leedom

[57] ABSTRACT

A microwave carton (2) including a bottom tray-shaped portion (4) having upstanding inner side wall panels (10,12,14,16) and a telescoping top portion (6) having downwardly extending side wall panels (30,32,34,36) wherein a layer (28) of microwave reflective material covers the entire interior surface of the top portion (6) and a vapor escape means (24) is provided for allowing vapor generated within the carton (2) to be vented to the exterior of the carton (2) by passing through a space formed between one inner side wall (10,12,13,16) and one outer side wall (30,32,34,36). The vapor escape means (24) may be formed by removing an upper portion of one of the inner side walls (10,12,14,16). One of each pair of corresponding sidewalls may be angled to for a space therebetween through which vapor may escape.

11 Claims, 5 Drawing Figures

SIDE VENTED AND SHIELDED MICROWAVE PIZZA CARTON

DESCRIPTION

1. Technical Field

This invention relates to food packaging suitable for use in a microwave oven and particularly relates to a carton having telescoping top and bottom portions in which refrigerated and frozen food, such as pizza, may be shipped, displayed, stored, cooked and served.

2. Background Art

The increasing use of microwave ovens has been accompanied by a demand for cooking containers which take maximum advantage of the rapidity of microwave cooking while at the same time producing final cooked foods which duplicate as closely as possible the cooking results of conventional ovens. In the case of pizza pies, this means that the bottom and side crust of the pie must be crisp and its top must be warm and soft. Moreover, to satisfy the needs of contemporary consumers, such containers must be economical, simple, disposable and capable of being used as hygenic, safe shipping cartons, display cartons especially and, sometimes, serving dishes. In the case of refrigerated and especially frozen food products, a substantial volume of water and grease in gaseous form are released during exposure to microwaves which must escape from the package in order to prevent the production of soggy or greasy food.

An attempt to produce a container to solve many of these problems is disclosed in the patent to Levinson (U.S. Pat. No. 4,027,132). This patent teaches the use in a pizza container of a microwave-reflective, steam-permeable cover to shield a pizza pie topping from direct exposure to microwave radiation while permitting free vertical passage of steam through perforations in the cover. However, the use of perforations in the container's cover has the multiple disadvantages, first, of permitting a certain amount of heat to escape with the steam, thus lengthening the required cooking time, second, of necessitating the use of an hygenic protective outer wrapping to cover the vent holes during shipment, storage and display, and, finally, of creating the danger that shavings formed during the cutting of the perforations in the paperboard will remain loosely attached to the top wall of the container, eventually falling into the foodstuff placed therein.

Several references suggest approaches to the venting problem other than the use of cover perforations. In the patent to Goltsos (U.S. Pat. No. 4,013,798), a compartmentalized microwave "cook-in" tray is disclosed which includes a rupturable microwave transparent top film covering a venting notch in the side wall of one compartment of the tray. However, this container is relatively expensive and complex, since the tray is constructed from plastic and requires the use of a separate metallic shielding box to protect portions of food from excessive exposure to microwave radiation. Side venting around a microwave shield is suggested in the patent to Moore et al (U.S. Pat. No. 3,854,021) which, however, discloses a permanent attachment of the shield to a microwave oven rather than to a disposable container.

Microwave containers constructed of paperboard and/or plastic have been disclosed in a number of patents. Such containers are relatively inexpensive and can be used for shipment, display and storage, but each of these containers has failed to eliminate all of the problems solved by the invention disclosed herein. For example, the patent to Mancuso (U.S. Pat. No. 4,058,214) discloses a pizza container including a lid arranged to provide vapor vents adjacent its periphery where the lid joins the upstanding sidewalls of the base portion of the container. However, the Mancuso container is designed for carrying and insulating pizza, and not for use in a microwave oven. The patent to Cherney et al (U.S. Pat. No. 4,345,133) discloses a telescoping paperboard carton designed for microwave exposure and having a steam venting feature, but the steam vents are in the top wall of the carton as in the patent to Levinson, discussed above.

Food trays are generally well known as illustrated by the patent to Wynee et al (U.S. Pat. No. 2,339,445) which discloses a paperboard tray having sculptured side walls, but this tray is not designed for microwave use and has no cooperating upper cover.

Thus, it has remained an elusive goal in the microwave container art to produce a "cook-in" container for refrigerated or frozen foodstuffs which is inexpensive, simple to manufacture, disposable and capable of providing complete microwave shielding for the top of the food in order to maximize cooking temperature while still providing adequate steam ventilation routes which neither mandate the use of an outer wrapping for hygenic reasons nor create the risk of contamination of the foodstuff through shavings inadvertently left on the edges of perforations cut above the food.

DISCLOSURE OF THE INVENTION

It is the primary object of the subject invention to overcome the deficiencies of the prior art by providing a microwave carton for more rapidly heating foodstuffs and simultaneously providing a heated product more closely resembling that which would be produced by a conventional oven.

A further object of the invention is to provide a carton for heating refrigerated and frozen food in a microwave oven which completely shields the top and sides of the food while still allowing vapors released during heating to escape from the carton.

Yet another object of the invention is to provide a carton for heating food in a microwave oven which provides vents in at least one side wall panel of the carton for vapors released during heating to escape from the carton.

Still another object of this invention is to provide a microwave carton manufactured from two separate unitary paperboard blanks, one of which forms a top portion and includes a microwave reflective layer for shielding the top and sides of food from exposure to microwave energy while the other forms a bottom portion and includes vapor escape passage means to allow vapors released during heating to escape from the carton.

Yet a further object of this invention is to provide a two-piece, telescoping microwave carton having a top portion with vertical, downwardly extending side wall panels and a bottom portion with vertical, upwardly-extending side wall panels which are spaced inwardly of and away from the side wall panels of the top portion and at least one of which includes vapor escape passage means for allowing vapors produced during heating to escape from the carton.

Still another object of this invention is to provide a two-piece, telescoping carton having a top portion with vertical, downwardly-extending side wall panels and a bottom portion with side wall panels extending-upwardly and angularly towards the side wall panels of the top portion.

Another object of this invention is to provide a two-piece, telescoping carton having a bottom portion with vertical, upwardly-extending side wall panels, at least one of which includes vapor escape passage means for allowing vapor produced during heating to escape from the carton and a top portion having side wall panels extending downwardly and angularly away from the side wall panels of the bottom portion.

Other and more specific objects of the invention may be understood from the following Brief Description of the Drawings and Best Mode for Carrying Out the Invention.

BEST MODE FOR CARRYING OUT THE INVENTION

Figure 1:
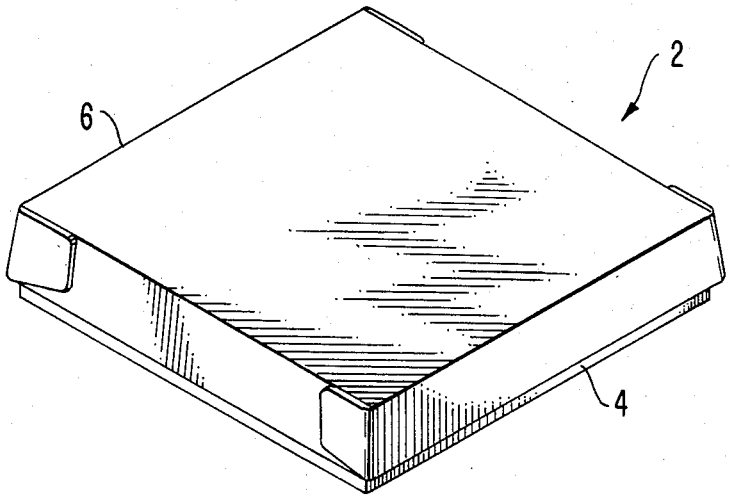
FIG. 1 is a perspective view of a carton designed in accordance with the invention, shown in closed position.

For a clear understanding of the subject invention, reference is initially made to FIG. 1 in which a microwave food carton 2 designed in accordance with the subject invention is illustrated. More specifically, the food carton 2 includes a bottom portion 4 formed from a first paperboard blank, only the bottom segment of which is discernible in FIG. 1, and a telescoping top portion 6 formed from a second paperboard blank.

The bottom portion 4 serves to receive and support food placed therein during packaging, shipping, storage, display and cooking periods and, further, provides a venting means for gases generated during exposure of food to microwaves to escape from food carton 2, as will be described below. The top portion 6 serves to retain food within food carton 2 during the various stages through which it passes, to protect the food from contamination during these stages, to shield certain layers of the food from direct exposure to microwaves, as will also be described below and to cause the temperature within the food carton 2 to rise quickly and remain high during heating.

Figure 2:
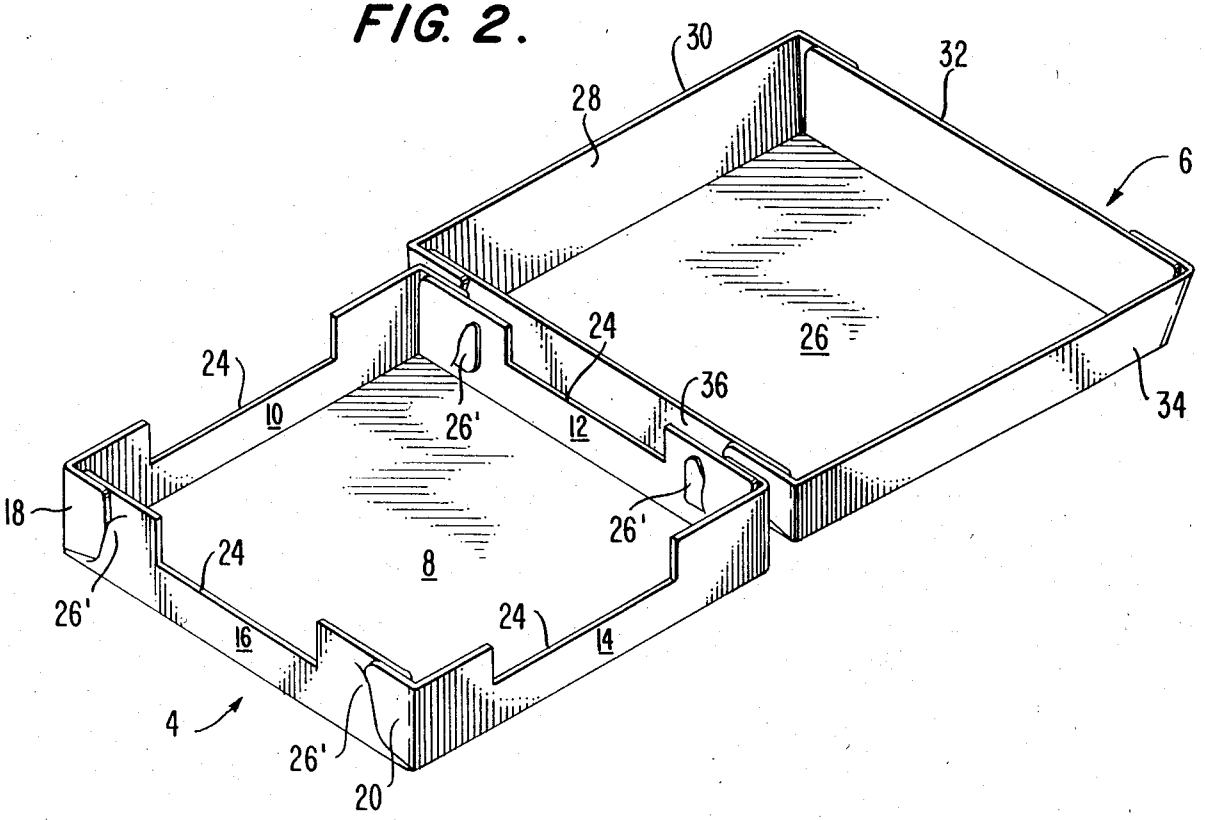
FIG. 2 is a perspective view of the carton of FIG. 1 shown in opened position.

The carton is shown in its open position to FIG. 2. The step of opening by the consumer simply involves lifting the top portion 6 from bottom portion 4. The use of paperboard is contemplated as the material from which bottom portion 4 is constructed, although other materials, such as plastics, may be employed, so long as the construction material does not shield the interior of the carton from the microwave energy. In the preferred embodiment shown in FIG. 2, the bottom portion has a generally rectangular or square bottom panel 8 and inner side wall panels 10, 12, 14 and 16 held together in a vertical position by closing tabs 18 and 20 which extend from the side edges of two opposed inner side wall panels 10 and 14. These closing tabs are engaged through slits 26' cut in the remaining opposed inner side wall panels to mechanically connect all of the inner side wall panels together. Each inner side wall panel of the bottom portion has had a generally rectangular segment thereof removed along its upper edge to form vapor escape passage means 24 to allow steam generated from food exposed to microwaves to exit from food carton 2.

The top portion 6 is preferably formed from paperboard and has a generally rectangular or square top panel 26 of approximately the same size as bottom panel 8. The top panel 26 includes a microwave reflective layer 28, such as a metal foil, laminated thereto. The microwave reflective layer 28 covers the entire inner surface of the top portion 6—the surface facing the bottom portion—and thus shields both the top of the bottom portion and substantially all of the side of the bottom portion from microwave radiation. The microwave reflective layer 28 could as well be laminated to the entire outer surface of the cover instead of the inner surface. An incidental advantage of foil on the inner surface is that it inhibits absorption of moisture in the paperboard from food within the carton. Integrally connected with top panel 26 are four trapezoidally-shaped cover outer side wall panels 30, 32, 34 and 36 so that when top portion 6 is erected, as described below, and disposed over bottom portion 4, the outer side wall panels extend downwardly and angularly away from top panel 26, leaving a space between each outer side wall panel and the corresponding, opposed inner side wall panel of bottom portion 4.

Figure 3:
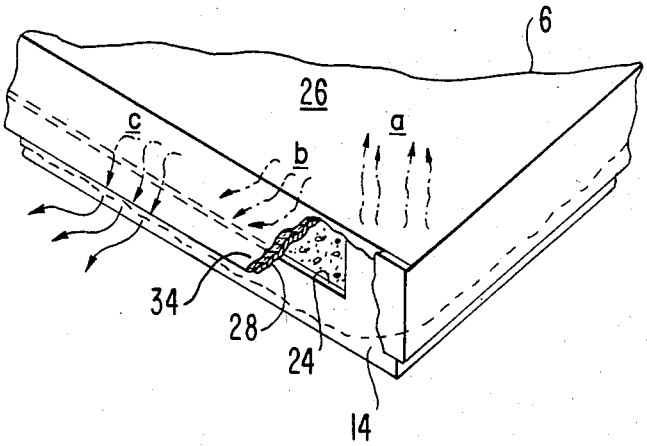
FIG. 3 is a perspective cut away view of the carton of FIG. 1 showing the means by which vapor escapes from the carton.

The combination of elements disclosed in this invention produces several unique advantages which are demonstrated by reference to FIG. 3 showing a cut-away perspective view of one side of food carton 2. When a food carton is used in a microwave oven to heat up foods such as refrigerated or frozen pizza pies, it is desirable both to provide ventilation means to allow moisture vapors to escape from the carton so that the food does not become soggy and to shield the top of the pizza pie from direct exposure to microwaves so that it does not become tough or overly crisp. In prior art microwave cartons, such as the patent to Cherney (U.S. Pat. No. 4,345,133), this has been accomplished by laminating the carton cover with a microwave shielding substance and perforating the carton cover with holes. These procedures are partially self-defeating since the holes allow not only moisture but also heat to escape from the carton, thereby lengthening the required heating time, and also permit the direct entry of microwave radiation, thus increasing the chance of producing an overly tough or crisp pizza topping. Moreover, the use of holes in the carton cover introduces the danger that shavings produced in making the holes will be left partially attached to the cover and may fall into the foodstuffs placed in the carton. While such shavings are harmless, they are unsightly and create consumer resistance to foods packaged in such containers. In addition, the use of holes raises an hygenic risk requiring the use of a wrapping around the carton to seal and protect it, thus complicating the use and raising the cost of producing such cartons.

All of the above problems are overcome by the invention disclosed herein. Since top portion 6 and microwave reflective layer 28 comprise one continuous layer, no heat escapes from the top of the carton and no microwaves enter the carton cover to strike a pizza pie placed therein. Thus, the temperature maintained within food carton 2 may be higher than in prior art cartons and cooking is accomplished both more quickly and with a higher quality resulting product than was possible using cartons disclosed in the prior art. Ventilation of vapors indicated by arrows in FIG. 3 occurs by natural movement of such heated vapors upwardly from the food placed within carton 2 until they strike at "a" the microwave reflective layer 28 laminated to top panel 26. Steam pressure eventually forces the vapors to move laterally through vapor escape passage means 24 striking outwardly angled outer side wall panels 30, 32, 34 or 36 at "b". The vapors then move downwardly along the respective outer side wall panel until they reach the lower edge "c" of the respective outer side wall panel and escape. In this fashion, all of the requirements of such cartons are efficiently resolved. Additionally, the carton need no longer be wrapped for hygenic reasons since the foodstuff contained therein is entirely protected from contact with external possibly contaminating substances. The carton may be kept closed by any of a variety of means, such as an adhesive strip, or even the optional, as opposed to the mandatory, use of a wrapper.

The unique elements of food carton 2 will be better understood after an explanation of the production, erection, assembly and various special features of the two paperboard blank components making up food carton 2.

Figure 4:
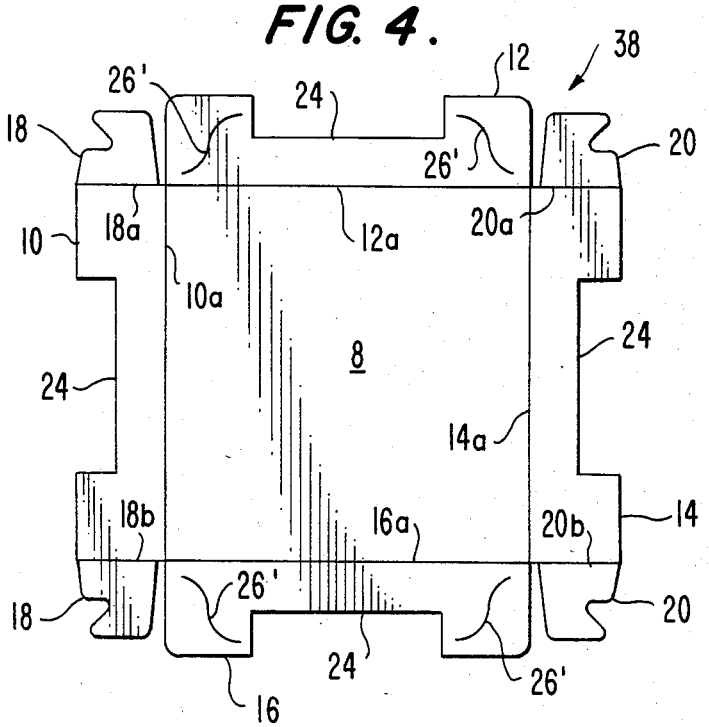
FIG. 4 is a plan view of a blank which can be assembled to form the bottom portion of the carton of FIG. 1.

The details of bottom portion 4 are best shown with reference to FIG. 4 which is a plan view of the single, unitary paperboard blank 38 from which the bottom portion is erected. Paperboard has a number of desirable characteristics which makes it ideally suited as the primary structural component of a disposable cook-in microwave container. In particular, paperboard is strong, microwave transparent, easily adapted to receive advertising display graphics and easily handled during container assembly. All of these advantages are enhanced by the inherent recycleability and biodegradability of paperboard.

Referring more specifically to the blank of FIG. 4, it is apparent that the blank is primarily cut and scored along two perpendicular sets of parallel lines to form a plurality of interconnected panels and flaps including the major panel 8, referred to as the bottom panel, which acts to support food during the microwave heating process. Four inner side wall panels 10, 12, 14 and 16 are connected along fold lines 10*a*, 12*a*, 14*a* and 16*a*, respectively, to bottom panel 8. Each inner side wall panel has had a rectangular segment removed therefrom during the production process to form a notch in what will become the upper edge of each sidewall when the blank of FIG. 4 is erected. These notches serve, as described above in relationship to FIG. 3, as vapor escape passage means 24. Two of the inner side panels, 10 and 14, include a pair of closing tabs, 18 and 20 respectively, which are connected to the respective inner side wall panel along foldlines 18*a*, 18*b*, 20*a* and 20*b*. The other two inner side wall panels, 12 and 16, each include a pair of closing slits 26', which are cut through each inner side panel to retain the closing tabs when the bottom portion blank 38 is erected to form bottom portion 4 as will be described next.

In order to erect bottom portion 4, inner side wall panels 12 and 16 are folded vertically upward along foldlines 12*a* and 16*a*. Each closing tab 18 and 20 is folded vertically upwardly along foldlines 18*a*, 18*b*, 20*a* and 20*b*, respectively, and the remaining inner side wall panels 10 and 14 are also folded vertically upwardly along foldlines 10*a* and 14*a*. Subsequently or simultaneously, pressure is exerted from the side of each inner side panel closest to bottom panel 8 after folding on the area of the edge of each closing slit 26' closest to vapor escape passage means 24 so as to fully separate and open each slit. Finally, tabs 18 and 20 are positioned to slide into closing slits 26', thereby forming bottom portion 4 as shown in FIG. 2.

Figure 5:
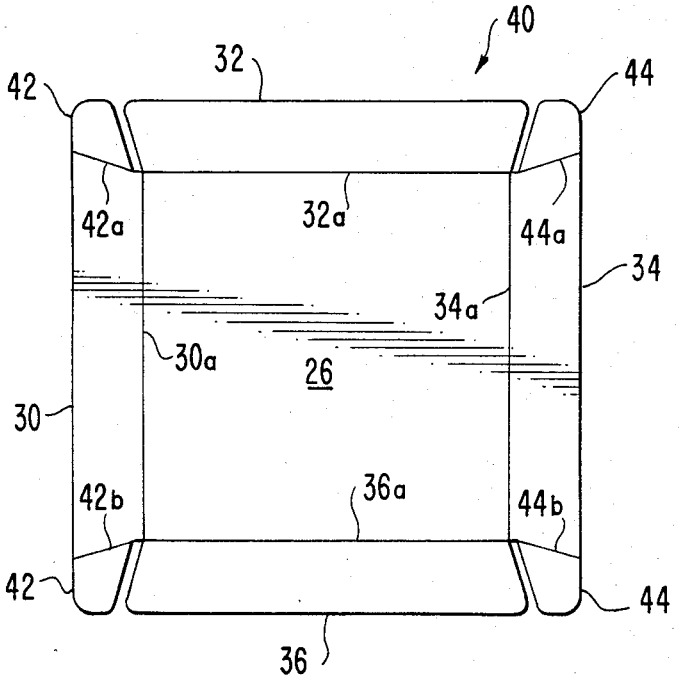
FIG. 5 is a plan view of a blank which can be assembled to form the top portion of the carton of FIG. 1.

The details of top portion 6 are best shown by reference to FIG. 5 which shows a plan view of the single, unitary paperboard blank 40 from which top portion 6 is erected. This blank is also cut and scored to form a plurality of interconnected panels and flaps including a major panel 26, referred to as the top panel, which is approximately of the same size and shape as bottom panel 8. Four outer side wall panels 30, 32, 34 and 36 are connected along fold lines 30*a*, 32*a*, 34*a* and 36*a*, respectively, to top panel 26. Each of two outer side wall panels 30 and 34 include a pair of sealing tabs 42 and 44, respectively, which are connected to the respective outer side wall panel along fold lines 42*a*, 42*b*, 44*a* and 44*b*. Each outer side wall panel is generally trapezoidally shaped, as shown in FIG. 5. When blank 40 is erected, this configuration produces a top portion 6 with outwardly flared outer side wall panels, a feature which is necessary to the proper functioning of the vapor escape passage means 24 in this embodiment of the invention, as was described above. Furthermore, one entire surface of blank 40 which will form the inner surface of top portion 6 oriented toward bottom panel 8 after food carton 2 is assembled, is laminated with a microwave reflective layer 28, not indicated in FIG. 5. This layer may be composed of any of a number of materials, such as metal foil, known in the art, and may be applied in any manner to the paperboard stock from which the blank of FIG. 5 is formed. Lamination of the foil to one entire surface of the stock is much less expensive than lamination of a foil layer which covers only one portion of one side of blank 40. The important features of this microwave reflective layer are that it be capable of substantially shielding the top and sides of food placed within food carton 2 from direct exposure to microwave radiation and that it be vapor impermeable so that heat generated during cooking remain within food carton 2 and vapor generated during cooking be forced to escape by means of the vapor escape passage 24, as described above.

In order to erect top portion 6, all of the outer side wall panels 30, 32, 34 and 36 are folded vertically upwardly along foldlines 30*a*, 32*a*, 34*a* and 36*a*. Then, sealing tabs 42 and 44 are folded approximately 90 degrees inwardly along fold lines 42*a*, 42*b*, 44*a* and 44*b* towards outer side wall panels 32 and 36 until they make face to face contact with the respective outer side wall panel. At some time during the production or assembly process, an adhesive is applied to either sealing tabs 42 and 44 or to outer side wall panels 32 and 36 or to both of them so that, when sealing tabs 42 and 44 are placed in contact with outer side wall panels 32 and 36, they remain in adhesive sealing relationship with each other, thereby holding outer side wall panels 30, 32, 34 and 36 in position and forming top portion 6.

At least two alternative embodiments of this invention may be used to produce the same result as the preferred embodiment already described. In the first such embodiment, bottom portion 4 is constructed exactly as in the preferred embodiment, but top portion 6 is manufactured so that top panel 26 has larger dimensions than bottom panel 8 and outer side wall panels 30, 32, 34 and 36 are rectangularly, rather than trapezoidally, shaped with somewhat shorter width dimensions than the inner side wall panels of bottom portion 4. As a result, when top portion 6 is erected and disposed over bottom portion 4 in this first alternative embodiment, outer side wall panels 30, 32, 34 and 36 are not flared so as to be spaced gradually away from the inner side wall panels along their length, but rather are spaced away from inner side wall panels 10, 12, 13 and 16 along their entire length, additionally leaving a small space between the end of each outer side wall panel and the surface on which food carton 2 is placed.

In the second alternative embodiment, top portion 6 is constructed as in the first alternative embodiment and bottom panel 8 is left in the same size and shape, but the inner side wall panels 10, 12, 13 and 16 of bottom portion 4 are altered so that they assume a trapezoidally-shaped outward and upward flare when bottom portion 4 is erected. Consequently, when top portion 6 is disposed over bottom portion 4 in this second alternative embodiment, the inner side wall panels are spaced unequally away from the outer side wall panels as in the preferred embodiment, but the inequality results from the outward flare of the inner side wall panels rather than from the outward flare of the outer side wall panels.

Other embodiments could include such features as a vapor escape passage means 24 in any one or more of the inner side wall panels of bottom portion 4, hinging together of the top portion 6 and bottom portion 4 along a foldline, outer side wall panels which are smaller than opposing inner side wall panels and vice versa, and inner and outer side wall panels which are spaced away from each other on less than all sides of the carton. Another important feature would be the inclusion of an interactive layer responsive to microwave energy and generates heat such as Canadian Pat. No. 1,153,069.

In each of these alternative embodiments, which by no means represent all of the possible variations of the construction of food carton 2 which will accomplish the goals of this invention, food placed within food carton 2 for heating is shielded on its top and sides from exposure to microwaves, heat generated by such exposure is maximized and retained within the carton and vapors generated during such exposure are vented by means other than holes formed in top panel 26.

INDUSTRIAL APPLICABILITY

This invention has particular utility in the packaging of food pieces for distribution and sale in refrigerated and frozen display cases now common in most grocery stores. The disclosed carton is ideally suited for packaging, shipping, vending and microwave heating of food products, such as refrigerated or frozen pizza, requiring shielding from direct exposure to microwaves on one or more sides while still allowing vapors released during such exposure to easily escape from the carton. The disclosed carton could, however, be used for a wide variety of other prepared food products.

I claim:

1. A carton for use in heating food in a microwave oven, comprising:

(a) a bottom portion having a bottom panel and at least a first side wall connected with and extending upwardly from said bottom panel;

(b) a top portion cooperating with said bottom portion to enclose a food receiving cavity, said top portion including a top panel and a second side wall panel connected with and extending downwardly from said top panel in laterally spaced apart relationship with said first side wall panel to form a generally vertically oriented passage;

(c) microwave reflecting means for reducing the amount of microwave energy entering the food receiving cavity through said top portion, said microwave reflecting means including a layer of microwave impervious material associated with said top portion; and (d) vapor escape passage means for causing vapor generated within the food receiving cavity to be vented to the exterior of the carton by passing through said vertically oriented passage formed between said first and second side wall panels without passing through said microwave impervious layer.

2. A carton as defined in claim 1, wherein said bottom portion and said top portion are formed from paperboard.

3. A carton as defined in claim 1, wherein said vapor escape passage means is formed by removing a portion of one said side wall panels.

4. A carton as defined in claim 1, wherein said bottom portion includes a plurality of inner side wall panels connected with and extending upwardly from said bottom panel, one of said inner side wall panels forms said first side wall panel and wherein said top portion includes a plurality of outer side wall panels connected with and extending downwardly from said top panel, one of said outer side wall panels forming said second side wall panel, each said outer side wall panel being positioned in a spaced relationship with a corresponding inner side wall panel.

5. A carton as defined in claim 4, wherein said top panel is approximately the same size as said bottom panel, said inner side wall panels are arranged perpendicularly with respect to said bottom panel and said outer side wall panels extend angularly away from said corresponding inner side wall panels.

6. A carton as defined in claim 4, wherein said top panel is larger than said bottom panel, said outer side wall panels are arranged perpendicularly with respect to said top panel, and said inner side wall panels extend angularly away from said corresponding outer side wall panels.

7. A carton as defined in claim 4, wherein said top panel is larger than said bottom panel, said outer side wall panels are arranged perpendicularly with respect to said cover top panel, and said inner side wall panels are arranged perpendicularly with respect to said bottom panel.

8. A carton as defined in claim 4, wherein said bottom portion is formed from a first unitary blank of paperboard cut and scored to form said bottom panel and said top portion is formed from a second unitary blank of paperboard cut and scored to form said top panel and said outer side walls.

9. A carton as defined in claim 8 wherein said layer of microwave impervious material is laminated to and covers one entire side of said second unitary blank.

10. A carton as defined in claim 4, wherein said top portion includes four outer side walls and said bottom portion includes four inner side walls having a vertical extent less than the vertical extent of said inner side walls and wherein said top and bottom portions may be assembled in telescoping relationship.

11. A carton as defined in claim 4, wherein said inner side wall panels are connected together to form a continuous inner side wall around said bottom panel and wherein said outer side wall panels are connected together to form a continuous outer side wall around said top panel.

* * * * *